United States Patent [19]

Blanco-Equiluz

[11] Patent Number: 5,054,164

[45] Date of Patent: Oct. 8, 1991

[54] DEVICE OF RAPID HOOKING FOR HINGES OF FURNITURE

[75] Inventor: Maria B. Blanco-Equiluz, Bilbao, Spain

[73] Assignee: Industria Tecnica de La Bisagra, S.A. (I.T.B.), Spain

[21] Appl. No.: 475,216

[22] Filed: Feb. 5, 1990

[30] Foreign Application Priority Data

Feb. 17, 1989 [ES] Spain ..... 8900505

[51] Int. Cl.[5] ..... E05D 7/06

[52] U.S. Cl. ..... 16/258; 16/382; 16/DIG. 43

[58] Field of Search ..... 16/257, 258, 382, DIG. 43

[56] References Cited

U.S. PATENT DOCUMENTS 4,888,853 12/1989 Rock et al. ..... 16/382

FOREIGN PATENT DOCUMENTS 43903 1/1982 European Pat. Off. ..... 16/DIG. 43

3516683 11/1986 Fed. Rep. of Germany .... 16/DIG. 43

*Primary Examiner*—Robert L. Spruill

*Assistant Examiner*—Carmine Cuda

*Attorney, Agent, or Firm*—Lucas & Just

[57] ABSTRACT

The rapid hooking device for furniture hinges has a base that is anchored to the furniture and a support that is connected to the articulated arm of the hinge. The device allows for rapid coupling and uncoupling.

9 Claims, 2 Drawing Sheets

DEVICE OF RAPID HOOKING FOR HINGES OF FURNITURE

SCOPE OF THE INVENTION

The device of this invention is intended to be applied to furniture hinges and the like, in which coupling of the articulated arm to the side frame of the piece of furniture is produced by rigid means, in that they do not allow for any positional adjustment between said arm and side frame, as well as to those other hinges, of more generalized use, in which the means of coupling established between said hinge arm and side frame of the piece of furniture allow for adjustements in up to three different directions: a first adjustment according to the horizontal depth of the piece of furniture, a second adjustment referred to the horizontal angle of the arm to the side frame and a third adjustment according to the vertical height of the piece of furniture.

In this second type of hinge with adjustment, it is common to use a chock or heel which, on the one hand, has means of anchoring to the side frame of the piece of furniture and, on the other, incorporates means for simultaneous hooking and positional adjustment of the articulated arm of the hinge with respect to said chock or heel.

PRIOR STATE OF THE ART

In the area of this invention, hinges of the type devoid of adjustments present the disadvantage that every time the door has to be demounted or mounted, it is necessary to free the anchoring of the arm to the side frame of the piece of furniture, which, in addition to being troublesome and laborious, implies that the means of anchoring have to be workable and, therefore, subject to weakening with wear, as well as to producing, on the successive demountings and mountings, a progressive deterioration of the side frame of the piece of furniture (generally fiberboard) which, abetted by the stresses generated in normal operation of the door, ends up by detracting from the firmness of the anchoring and causing looseness that can make it advisable to change the place of anchoring of the hinge.

In the case of hinges provided with adjustments, the added problem exists that any possible demounting of the door can alter the concrete spatial positioning preestablished through said adjustments, which in turn makes it slower and more laborious for the new mounting to determine the best positional adjustment again, not to mention the fact that such new adjustment has to be made on the installation site itself, when it might be more appropriate to do it at the factory.

To avoid these problems, the object of this invention is the development of a rapid-hooking device that responds to the basic functional philosophy of inserting, between the side frame of the piece of furniture and the hinge arm or chock, a mechanism which by simple manual assembly and pressure operations is capable of producing a practicable coupling between the arm or chock and a base permanently anchored to said side frame of the piece of furniture, so that, in the case of hinges without adjustment, it will no longer be necessary to touch the anchoring to the side frame of the piece of furniture and, in the case of hinges with adjustment, the latter will not be affected, because now the means for producing it are different from those employed for fastening between the arm and the side frame of the piece of furniture.

EXPLANATION OF THE INVENTION AND ADVANTAGES

The rapid-hooking device now proposed is of a new and advantageous design whereby, referred to its bearing on a horizontal plane, it comprises a fixed lower part, or base, that can be anchored to the side frame of the piece of furniture, and a removable upper part, or support, that can be connected to the articulated arm of the hinge by any fixed or adjustable means; said base having corresponding collateral external curved bosses located along a common front transverse axis with respect to the hinge joint, as well as a rear housing, open at the top and with passage obstructed by corresponding longitudinal facing teeth, each formed by the conjunction of a descending outer surface and an inner retaining shoulder; and said support having corresponding collateral front hook-shaped notches hingeable on the curved bosses of said base, as well as a back recess open at the bottom and coincident on said housing in hinging of said base and support to each other, which recess has mounted floating along its horizontal transverse axis corresponding independent moving hooks functionally cooperating with said teeth, hooks that are retractable to their mutual central abutment against a tension spring operationally inserted between both; what takes place is that, in the retracted or compressed spring position, the active profiles of said hooks can pass together between said teeth and, once inside the housing, the relaxation of said spring impels these active profiles of the hooks to their operational coupling with said teeth.

According to the invention, the active profile of the retractable hooks functionally complements that of said teeth and is formed by a lower surface converging toward the center and continued by an upper retaining shoulder; what happens is that in the hinged lowering of the support on the base, a situation prior to coupling is produced, in which said convergent surfaces of the retractable hooks are seized, bearing correspondingly on the descending surfaces of the teeth, so that by exerting pressure on said support a mutual sliding of said surfaces takes place, which causes the retraction of the hooks and their coupling in the housing of the fixed base.

This arrangement of the invention is not only very simple, but is easily and efficiently functional, it being sufficient to hinge the hook-shaped notches of the removable support in front with the curved bosses of the fixed base and then exert pressure on the removable support in the back, getting the hooks to retract elastically and enter the housing of the fixed base, where the operational coupling with the teeth obstructing the entrance to said housing is determined by elastic recovery.

This simple and rapid coupling operation contrasts with the laborious and cumbersome nature of the hinges described in the prior state of the art, with the added advantages, furthermore, that on demountings and new mountings of the hinge no action on the anchoring to the side frame of the piece of furniture is necessary and the preestablished adjustments remain unchanged.

To produce uncoupling, it is sufficient to press both retracting knobs simultaneously until getting the active profiles of the hooks to come out again from the housing, an operation which, requiring the simultaneous use of two fingers, has the advantage that uncoupling cannot take place fortuitously.

According to the invention, the retractable hooks are identical to each other and each comes with a retracting knob that juts out and works passing through the corresponding side wall of the recess, as well as with a projection that slides along a respective transverse track machined in the proper transverse wall of said recess, a track whose innermost or centered end is reached by the projection when the hook comes to occupy its central position of abutment with the opposite hook, said projection preferably emerging asymmetrically in relation to the axis of the transverse drive of the retracting knob and therefore being symmetrically out of alignment with the projection of the opposite knob, while the respective tracks of both projections partially coincide on the longitudinal axis of the support, together shaping a staggered slot that in its center forms stops on the individual retraction path of each retractable hook.

In addition to the simplicity entailed in the fact that both hooks are identical, the projection/track arrangement has the advantage of guaranteeing the symmetry of the stress applied, since when, for example, on retraction of the hooks one of the projections reaches the end of its track before the other, continuity in the application of said stress produces an automatic shift to the other hook, which will thus complete its retraction path.

Another characteristic of the invention consists of the fact that said horizontal transverse axis (along which the transverse displacement of the retractable hooks takes place) is materialized in the form of a guide bar that has the tension spring mounted in its center and the ends of which work axially in corresponding cavities determined in the proper retractable hooks.

According to another characteristic of the invention, said curved bosses and notches hingeable to each other are shaped according to reciprocal profiles constituted by a first arched front lower part, continued upward and backward along a horizontal intermediate part, which in turn is continued backward along a last obliquely descending rear part that ends somewhat below the lower end of said arched part; that arched part, in the case of the curved bosses, manages to complete a semicircumference of vertical diameter that, on lower continuation of this diameter, joins with a previous additional vertical part, while, in the case of the notches, before completing the semicircumference the lower end of the corresponding arched part is finished off in an opposite rounding of lesser radius that, farther along, joins an ascending oblique lower edge. This characteristic makes possible correct hinging during the hooking depression, as well as, once hooking is produced, a perfect coupling of the removable support on the fixed base.

Another characteristic of the invention consists of the fact that on the operational hooking of said fixed base and removable support and on each side frame, corresponding oblique steps are coupled to each other, being determined in the back with respect to the hinging of said curved bosses and notches to each other and being tilted in the back at an angle close to 90°. This characteristic affords the advantage that, once operational hooking of the base and support is produced, the stresses derived from working of the hinge are absorbed between the arched part of each curved boss (in front) and each respective oblique step (in back), so that the hooking mechanism is not impaired.

DRAWINGS AND REFERENCES

To understand the nature of this invention better, we have represented on the attached plans one preferred industrial embodiment, which is in the nature of a merely illustrative example and is not limitative.

FIG. 1 is an exploded perspective that shows the different components of the device recommended in their respective mounting positions.

FIGS. 1-A and 1-B are each expanded views in projection corresponding to the details indicated on the figure relative to the notch (5) and curved boss (3) profiles.

Figure 4:
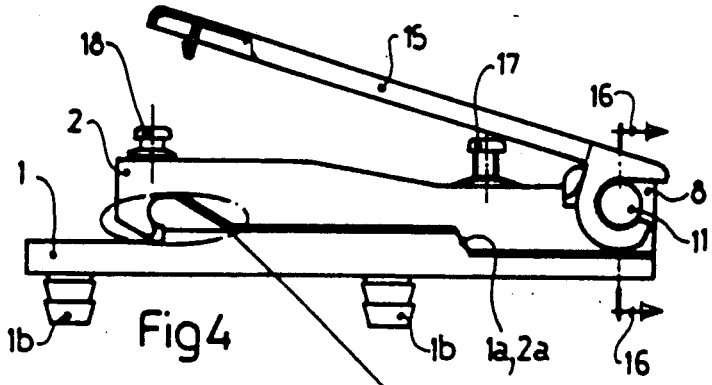
FIG. 4 is a side view in orthogonal projection that corresponds to FIG. 3.

FIG. 4-A is an expanded view of the surrounded detail on FIG. 4 relative to the hinging of curved boss (3) and notch (5).

Figure 5:
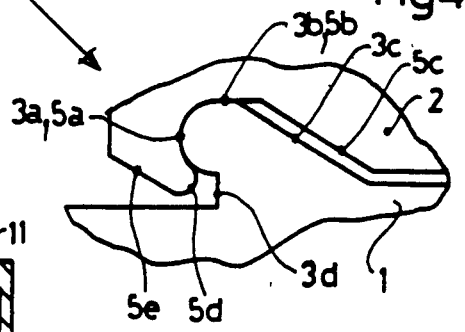
Figure 5:
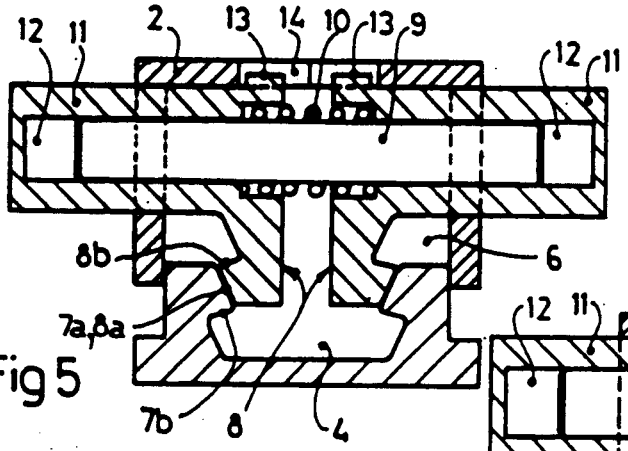
Figure 6:
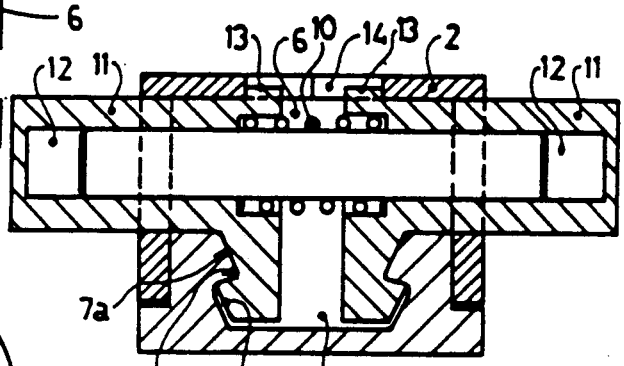

FIGS. 5 and 6 respectively show the prehooking and hooking positions, as indicated by section (16) of FIG. 4.

Figure 7:
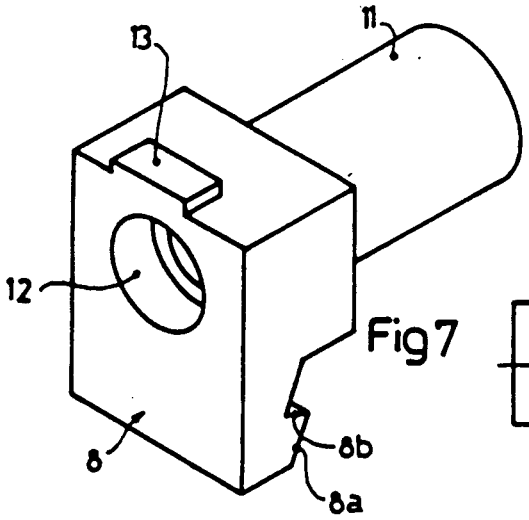

FIG. 7 is a view in perspective corresponding to the retractable hook (8) appearing on the right on FIG. 6.

Figure 8:
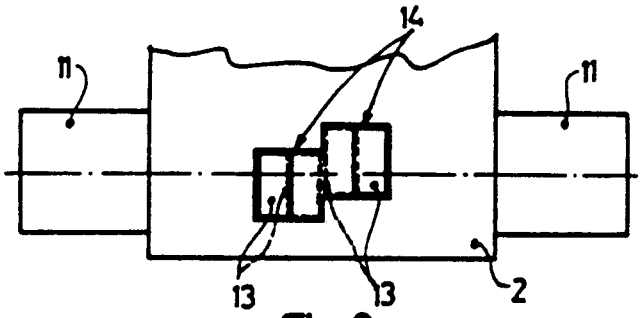

FIG. 8 is a top plan view which, corresponding to FIG. 6, shows the arrangement and operating position of the off-center projections (13) in the staggered slot (14).

On these figures the following references are indicated:

1. Fixed lower base
1*a*. Oblique step
1*b*. Anchor chocks
2. Removable upper support
2*a*. Oblique step
3. Lateral curved bosses on the fixed base (1)
3*a*. Semicircumferential arched part
3*b*. Horizontal intermediate part
3*c*. Oblique back part
3*d*. Previous vertical part
4. Rear housing of fixed base (1)
4*a*. Bevels
5. Hook-shaped front notches of removable support (2)
5*a*. Arched part
5*b*. Horizontal part
5*c*. Oblique part
5*d*. Rounding
5*e*. Oblique edge
6. Back recess of removable support (2)
6*a*. Lateral walls of recess (6)
6*b*. Transverse wall of recess (6)
7. Longitudinal teeth of housing (4)
7*a*. Descending surface or slope
7*b*. Retaining shoulder
8. Retractable hooks
8*a*. Lower surface or slope
8*b*. Retaining shoulder
9. Transverse pin or guide bar
10. Tension spring
11. Retracting knobs
12. Axial cavities 13. Off-center projections
14. Transverse tracks or staggered slot
15. Ornamental cap
16. Section indicator
17 and 18. Fastening and longitudinal and angular adjustment screws for hinge blade

PRESENTATION OF A DETAILED EMBODIMENT

Figure 1:
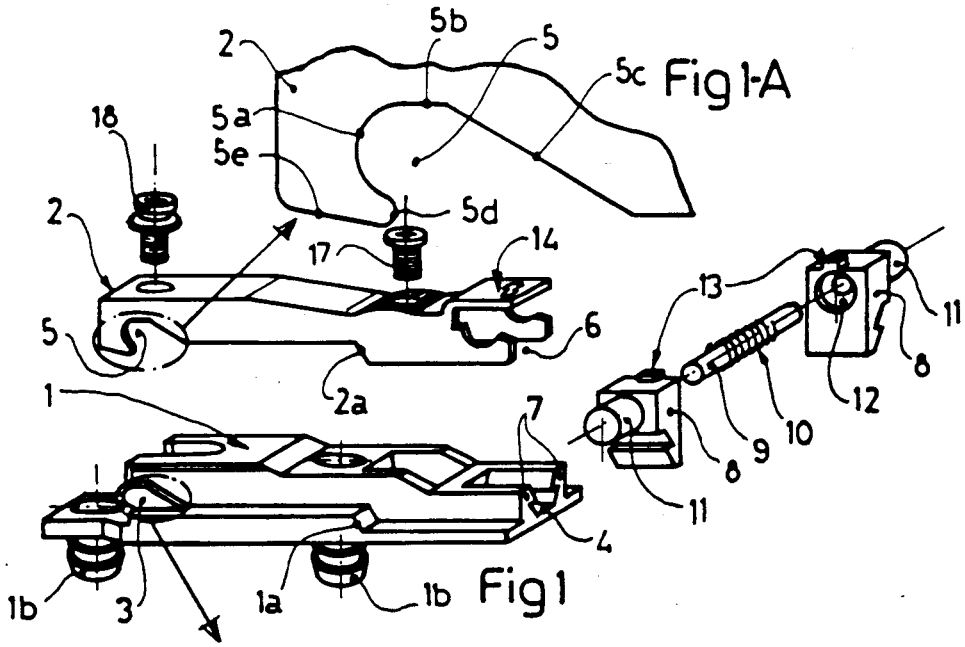

The drawings indicated illustrate a preferred embodiment of the invention relating to a rapid-hooking device for furniture hinges which, as FIG. 1 shows, basically consists of: a fixed base (1) permanently anchorable to the side frame of the piece of furniture with anchor chocks (1*b*) or by any other means, practicable or not; a removable support (2); an elastic hooking mechanism incorporated in said removable support (2); and an ornamental cap (15) that can be fastened on the knobs (11) or on the front of the screws (17 and 18) for hooking of the hinge blade.

The fixed base (1), on its front part or part closest to the hinge joint, has curved bosses (3) shaped (FIG. 1-B) externally, which are outlined along a semicircumferential arched part (3*a*) preceded below by a vertical part (3*d*) and continued above along a horizontal part (3*d*), which in turn is finished off by the oblique part (3*c*); and in its back part, this fixed base (1) has the housing (4) formed, intended to facilitate operational hooking by means of the facing longitudinal teeth (7) that choke its open upper mouth, which teeth (7) are outlined (FIGS. 1, 5, 6 and 7) along an outer slope (7*a*) continued with an inner retaining shoulder (7*b*), which in turn are joined with the bottom of the housing (4) by means of a wall parallel to said slope (7*a*).

Figure 2:
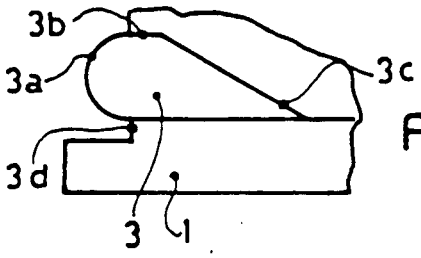
FIG. 2 is a perspective that shows the retractable hooks (8) already mounted on the removable support (2) and the latter in a prehooking position with respect to the fixed base (1).
Figure 2:
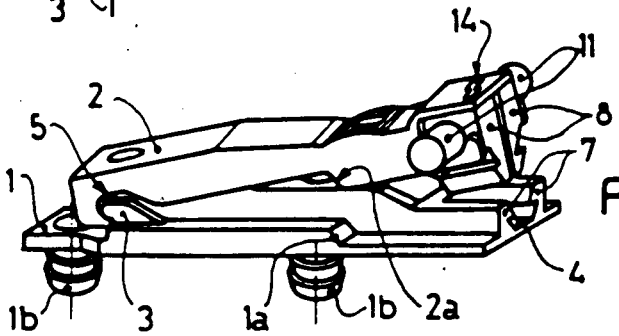
Figure 3:
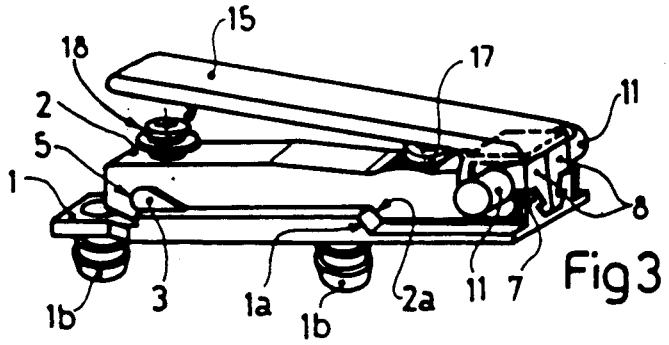
FIG. 3 is a perspective that shows the unit of FIG. 2 already operationally hooked and with the ornamental cap (15) in half-lowered position.

The removable support (2), in its front part, forms (FIG. 1-A) the hook-shaped notches (5) that are outlined along corresponding arched (5*a*), horizontal (5*b*) and oblique (5*c*) parts which are reciprocal with those defined in the curved bosses (3), with the peculiarity that now the arched part (5*a*) does not complete (FIG. 4-A) the semicircumference below and, instead, connects with a rounded part (5*d*) that finishes by means of the oblique edge (5*e*), which is directed upward to favor (FIG. 2) hinging with the curved bosses (3) during oblique coupling of the support (2) on the base (1) as a step preliminary to achieving operational hooking; and in its back part this removable support (2) defines the recess (6) delimited by the side walls (6*a*) and another upper transverse wall (6*b*), the recess (6) intended to accommodate the elastic hooking mechanism described below.

The elastic hooking mechanism consists (FIGS. 1, 5 and 6) of two identical retractable hooks (8) that are mounted by means of the tension spring (10) at the ends of a guide bar (9), located in transverse horizontal position, so that these ends work axially in respective cavities (12) of said hooks (8), enabling them to be retracted in approximation to each other by overcoming the expansive action of the spring (10) that tends to press them against said side walls (6*a*). Each hook has an external lower active profile outlined along a slope (8*a*) and a shoulder (8*b*) reciprocal with those having the longitudinal teeth (7); on the other hand, the retractable hooks (8) have a retracting knob (11) that juts out through the side wall (6*a*) and is intended to facilitate the manual retraction of same for hooking/unhooking, as well as a transverse off-center projection (13) that works in a corresponding track (14) which, with that of the opposite projection (13), forms the continuous staggered slot defined on the transverse wall (6*b*) of the recess (6), so that the stop of each projection (13) in the center step of said slot (14) corresponds to the fact that its hook (8) reaches the operating position of central abutment to the other hook (8), in which hooking/unhooking can take place through the choked mouth of the housing (4). The configuration and arrangement of the retractable hooks (8) are clearly illustrated on FIGS. 1 and 5 to 8.

The function is extremely simple and rapid and is illustrated on FIGS. 2, 3, 5 and 6. It consists of the fact that, after hinging (FIG. 2) takes place, a first depression causes the slopes (8*a*) of the hooks (8) to bear (FIGS. 2 and 5) on the slopes (7*a*) of the teeth (7), it now being sufficient to exert a moderate vertical pressure on the support (2) for the sliding cooperation between said slopes (8*a*, 7*a*) immediately to cause retraction of the hooks (8), enabling their active profiles to enter (FIGS. 3 and 6) the housing (4) and the respective retaining shoulders (8*b*, 7*b*) to be hooked to each other (FIGS. 3 and 6); this retraction can also be produced by acting on the retracting knobs (11) simultaneously with one finger applied to each. For unhooking to take place, it will be necessary to act on the retracting knobs (11) in the manner explained and then leave the housing, the advantage of the combined arrangement of off-center projection (13) and transverse track (14) now being evident, by means of which arrangement, when the retraction stress applied is asymmetrical and one of the hooks reaches the end of its travel, maintenance of the retracting action is automatically shifted to the other hook (8), thereby definitely ensuring that the stress applied ends up being symmetrical and makes the abutment of the hooks (8) to each other exactly coincide with the central operating position.

FIG. 4 shows the hooking position in which the steps (1*a*, 2*a*) are coupled to each other in the same way as takes place (FIG. 4-A) between the curved bosses (3) and notches (5), a joint arrangement that makes it possible to absorb the stresses generated by use, thus preventing them from being exerted on the hooking mechanism.

The nature of this invention as well as its industrial application having been sufficiently described, it need only be added that, in the unit as a whole and its components, it is possible to introduce changes of form, material and arrangement, within the context of the invention, without that detracting from its basis.

I claim:

1. A rapid-hooking device for furniture hinges, characterized in that, said device comprises a fixed lower base (1) that can be anchored to a side frame of a piece of furniture, and a removable upper support (2) that can be connected to an articulated arm of the hinge by any fixed or adjustable means; said base (1) having corresponding collateral external curved bosses (3) located along a common front transverse axis with respect to the hinge joint, as well as a rear housing (4), open at the top and having corresponding longitudinal facing teeth (7), each said tooth formed by the conjunction of a descending outer surface (7*a*) and an inner retaining shoulder (7*b*); and said support (2) having corresponding collateral hook-shaped notches (5) hingeable on the curved bosses (3) of said base (1), as well as a back recess (6) open at the bottom and coincident on said housing (4) in the hinging of said base (1) and support (2) to each other, which recess (6) has corresponding moving hooks (8) mounted floatingly along its horizontal transverse axis (9) said corresponding moving hooks (8) functionally cooperating with said teeth (7), said hooks being retractable to their mutual central abutment against a tension spring (10) which is operationally inserted between said teeth; wherein, in a retracted or compressed spring (10) position, the active profiles of said hooks (8) can pass together between said teeth (7) and, once inside the housing (4), the relaxation of said spring (10) impels these active profiles of the hooks (8) to their operational coupling with said teeth (7).

2. Rapid-hooking device for furniture hinges, of claim 1, characterized in that the retractable hooks (8) are indentical to each other and each comes with a retracting knob (11) that juts out and works passing through the corresponding side wall (6*a*) of the recess (6), as well as with a projection (13) that slides along a respective transverse track (14) machined in the proper transverse wall (6*b*) of said recess (6), a track (14) whose innermost or centered end is reached by a projection (13) when the hook (8) comes to occupy its central position of abutment with the opposite hook (8).

3. Rapid-hooking device for furniture hinges, of claim 2, characterized in that said horizontal transverse axis (9) is materialized in the form of a guide bar that has the tension spring (10) mounted in its center and the ends of which work axially in corresponding cavities (12) determined in the proper retractable hooks (8).

4. Rapid-hooking device for furniture hinges, of claim 3, characterized in that said curved bosses (3) and notches (5) hingeable to each other are shaped according to reciprocal profiles constituted by a first arched front lower part (3*a*, 5*a*), continued upward and backward along a horizontal intermediate part (3*b*, 5*b*), which in turn is continued backward along a last obliquely descending rear part (3*c*, 5*c*) that ends somewhat below the lower end of said arched part (3*a*, 5*a*); that arched part (3*a*, 5*a*), in the case of the curved bosses (3), manages to complete a semicircumference of vertical diameter that, on lower continuation of this diameter, joins with a previous additional vertical part (3*d*), while, in the case of the notches (5), before completing the semicircumference the lower end of the corresponding arched part (5*a*) is finished off in an opposite rounding (5*d*) of lesser radius that, farther along, joins an ascending oblique lower edge (5*e*).

5. Rapid-hooking device for furniture hinges, of claim 4, characterized in that on the operational hooking of said fixed base (1) and removable support (2) and on each side frame, corresponding oblique steps (1*a*, 2*a*) are coupled to each other, being determined in the back with respect to the hinging of said curved bosses (3) and notches (5) to each other and being tilted in the back at an angle close to 90°.

6. Rapid-hooking device for furniture hinges, of claim 3, characterized in that the active profile of the retractable hooks (8) functionally complements that of said teeth (7) and is formed by a lower surface (8*a*) converging toward the center and continued by an upper retaining shoulder (8*b*); wherein in the hinged lowering of the support (2) on the base (1), a situation prior to coupling is produced, in which said convergent surfaces (8*a*) of the retractable hooks (8) are seized, bearing correspondingly on the descending surfaces (7*a*) of the teeth (7), so that by exerting pressure on said support (2) a mutual sliding of said surfaces (7*a*, 8*a*) takes place, which causes the retraction of the hooks (8) and their coupling in the housing (4) of the fixed base (1).

7. Rapid-hooking device for furniture hinges, of claim 6, characterized in that the active profiles of the retractable hooks (8) and of the teeth (7) are joined and are mutually formed by corresponding slopes (8*a*, 7*a*), continued at respective retaining shoulders (8*b*, 7*b*).

8. Rapid-hooking device for furniture hinges, of claim 7, characterized in that between the shoulders (7*b*) of the teeth (7) and the bottom of the housing (4) it is arranged for the side wall of the latter to have a profile joined with that of the lower convergent surface (8*a*) of the corresponding retractable hook (8).

9. Rapid-hooking device for furniture hinges, of claim 2, characterized in that said projection (13) emerges asymmetrically in relation to the axis of transverse drive of the retracting knob (11) and is therefore symmetrically out of alignment with the projection (13) of the opposite knob (11), while the respective tracks (14) of both projections (13) partially coincide on the longitudinal axis of the support (2), together shaping a staggered slot that in its center forms stops on the individual retraction path of each retractable hook (8).

* * * * *